US006876334B2

(12) United States Patent
Song et al.

(10) Patent No.: US 6,876,334 B2
(45) Date of Patent: Apr. 5, 2005

(54) WIDEBAND SHORTED TAPERED STRIP ANTENNA

(75) Inventors: Peter Chun Teck Song, Hong Kong (CN); Ross David Murch, Hong Kong (CN)

(73) Assignee: Hong Kong Applied Science and Technology Research Institute Co., Ltd., Kowloon (CN)

( * ) Notice: Subject to any disclaimer, the term of this patent is extended or adjusted under 35 U.S.C. 154(b) by 0 days.

(21) Appl. No.: 10/377,128

(22) Filed: Feb. 28, 2003

(65) Prior Publication Data

US 2004/0169609 A1 Sep. 2, 2004

(51) Int. Cl.[7] ..... H01Q 7/00
(52) U.S. Cl. ..... 343/767; 343/866
(58) Field of Search ..... 343/767, 786, 343/866

(56) References Cited

U.S. PATENT DOCUMENTS

| | | | | |
|---|---|---|---|---|
| 4,853,704 A | | 8/1989 | Diaz et al. | |
| 5,428,364 A | | 6/1995 | Lee et al. | |
| 5,440,316 A | * | 8/1995 | Podgorski et al. | 343/786 |
| 5,748,152 A | | 5/1998 | Glabe et al. | |
| 6,437,756 B1 | * | 8/2002 | Schantz | 343/866 |
| 6,650,295 B2 | * | 11/2003 | Ollikainen et al. | 343/700 MS |

OTHER PUBLICATIONS

Lee et al., "Tapered Slot Antenna," Advances in Microstrip and Printed Antennas, Wiley Series in Microwave and Optical Engineering, 1997, pp. 443–453.
Daniel H. Schaubert, "Wide–Band Phased Arrays of Vivaldi Notch Antennas," IEEE, 1997, pp. 1.6–1.12.
Agrawall et al., "Wide–Band Planar Monopole Antennas," IEEE Transactions on Antennas and Propagation, vol. 46, No. 2, Feb. 1998.
Song et al., "Multi–Circular Loop Monopole Antenna," Electronics Letters, vol. 36, No. 5, Mar. 2, 2000, pp. 391–393.

* cited by examiner

*Primary Examiner*—James Vannucci
(74) *Attorney, Agent, or Firm*—Fulbright & Jaworski LLP

(57) ABSTRACT

Disclosed are systems and methods which provide a tapered conductor strip adapted for broadband wireless communication. Embodiments provide a conductor strip which is curved along its face, thereby providing an aperture taper. The conductor strip configured to provide an aperture taper may be placed over a planar ground plane to form a wideband tapered strip antenna element. Embodiments further provide a conductor strip which is curved along an edge or edges thereof, thereby providing an impedance taper. The dimensions of the impedance taper are preferably selected to provide a desired characteristic impedance with respect to an antenna element formed therefrom. Embodiments may further include a shorting pin or shorting plate configuration to generate an additional mode.

71 Claims, 7 Drawing Sheets

WIDEBAND SHORTED TAPERED STRIP ANTENNA

TECHNICAL FIELD

The present invention relates generally to wireless communication and, more particularly, to tapered strip antenna element configurations for providing wideband signal communication.

BACKGROUND OF THE INVENTION

Wireless communication of signals typically involves the use of defined bands of frequency spectrum from which a carrier signal or signals are utilized. Frequency bands utilized by many wireless communication systems are relatively narrow, allowing antennas to be tuned to resonate at a particular frequency for reception and/or transmission of signals within the relatively narrow frequency band of the system. Such antennas generally do not provide good wideband frequency response.

Various wideband antenna configurations have been developed in the past for specific uses, such as military and space applications including radar. For example, tapered slot, horn, spiral, conical, log periodic and planar circular monopole antennas have been utilized in wideband communications.

The tapered slot antenna was first introduced in 1974 and was later improved in 1979 to employ an exponential taper configuration, giving better broadband impedance matching. Exponential taper configurations of a taper slot antenna, generally referred to as Vivaldi aerials, are shown in FIGS. 1A–1C. These antenna configurations provide wideband characteristics, delivering high gain with a directive radiation pattern.

As can be seen in FIGS. 1A–1C, the tapered slot antenna physical structure is "blade" like, wherein cathode (shown as element 101 in FIG. 1A) and anode (shown as element 102 in FIG. 1A) conductors are disposed in a plane having a tapered slot therebetween. The tapered slot acts as a waveguide to setup the fields for efficient radiation. A signal input/output is provided at,the tapered slot end (designated R in FIG. 1B) and the antenna aperture (designated A in FIG. 1B) is defined by the taper of the slot.

As can be seen in FIGS. 1A–1C, the tapered slot antenna includes two regions; a setup region and a flare region. The antenna design usually requires a long setup region to give directivity, resulting in tapered slot antennas which are generally relatively long in the axial direction. Accordingly, the antenna length (designated L in FIG. 1B) is typically in the range of $2\lambda_o<L<12\lambda_o$, where $\lambda_o$ is the free space wavelength of the lowest resonance frequency of the antenna. Such a relatively long antenna configuration can be useful in providing very clean polarization. However, the space required for such long antenna configurations makes the antenna characteristics more sensitive to placement and, hence, limited application in various mobile communication or other systems.

The width of the aperture (A) determines the lowest resonance frequency (i.e., $A \geqq \lambda_0/2$, where $\lambda_0$ is free space wavelength of the lowest resonance frequency). However, there is often a problem with lower frequency termination. Specifically, as shown above, the aperture is the half wave length of the lowest resonate frequency of the antenna and, at this frequency, the antenna is not well matched because currents are not terminated properly. As can be appreciated from the foregoing, tapered slot antennas provide poor matching characteristic for lower operating frequencies, where flare aperture of the antenna is at its maximum.

Impedance of a tapered slot antenna is not constant over a large frequency range. Accordingly, an optimized taper may present a "self-similar" like condition to the current vector launched within the slot. An imbalance resulting in unsymmetrical current flow will also degrade the propagation of certain frequencies, thereby reducing broadband performance and radiation efficiency. Accordingly, tapered slot antennas utilize balanced feed systems to ensure radiation patterns are controlled. For example, a cathode and anode feed are typically implemented for aperture radiation equivalent to a dipole, thus requiring a balanced feed mechanism.

Antipodal Vivaldi aerial configurations have been developed in an attempt to provide more balanced fields. FIG. 1C shows an antipodal Vivaldi aerial configuration. Although providing improvement with respect to balanced fields, such antenna configurations still suffer from the other disadvantages associated with Vivaldi aerial configurations discussed above.

Planar circular monopole antennas comprise a disk shaped plate as a monopole providing omni-directional communications. An example of a planar circular monopole antenna is shown in FIG. 2, wherein disk shaped plate 201 is disposed orthogonal to ground plane 202. The use of such antennas is typically limited to indoor use.

The design of planar circular monopole antennas typically provides very broadband communication. However, at the higher operating bands, the radiation begins to experience substantial multi source contribution. Accordingly, the radiation pattern associated with a planar circular monopole antenna starts to deteriorate at these frequencies. Accordingly, the operating frequencies for such antennas are effectively limited by the radiation pattern being deteriorated to roughly a couple of wavelengths above the lowest frequency the antenna is designed for.

According to the planar circular monopole antenna design, the height of the disk is typically sized to correspond to the quarter wave length of the lowest frequency the antenna is designed for. Accordingly, the size of planar circular monopole antennas are typically relatively large. Moreover, at this lowest frequency, the impedance is not well matched because of current termination.

Broadband parallel plate antennas, shown in detail in U.S. Pat. No. 5,748,152 issued to Glabe et al., the disclosure of which is hereby incorporated herein by reference, provide a slot antenna element on a substrate material having a conductive plate thereover. As shown in FIG. 3, slot 310 comprises two flared slot sections 311 and 312 which are extended towards the back of the flare in both cathode 301 and anode 302, respectively. These slots are filled with absorptive material, primarily to minimize the overall aperture dimensions as well as to provide a better current termination. This antenna provides a relatively complex antenna configuration requiring additional manufacturing cost and larger antenna size.

BRIEF SUMMARY OF THE INVENTION

The present invention is directed to systems and methods which provide a shorted tapered conductor strip adapted for broadband wireless communication. According to a preferred embodiment, a conductor strip is curved along its face to thereby provide a taper (referred to herein as an aperture taper), characteristics of which are selected for broadband wireless communication. The conductor strip configured to provide an aperture taper is placed over a planar ground plane, such that the conductor strip acts as an anode and the ground plane substitutes as the corresponding cathode, to form a wideband tapered strip antenna element according to a preferred embodiment of the invention. Embodiments of the present invention are adapted such that the current launched by a signal feed mechanism, preferably disposed at a position in a gap between the conductor strip and the ground plane where the gap is smallest, propagates to the aperture of the wideband tapered strip antenna element and remains in a self-scalable condition, ensuring broadband behavior.

The conductor strip of a preferred embodiment is curved along an edge or edges thereof to thereby provide a taper (referred to herein as an impedance taper), characteristics of which are selected for broadband communication. The impedance taper of one embodiment tapers the edges of the conductor strip along the face having the aforementioned aperture taper such that a relatively thin conductor strip portion remains at a position nearest a signal feed mechanism, gradually broadening as the face having the aforementioned aperture taper is traversed. The dimensions of the impedance taper are preferably selected to provide a desired characteristic impedance with respect to an antenna element formed therefrom. For example, the impedance taper may be selected to ensure that the wideband tapered strip antenna element is matched to a conventional 50Ω port, while delivering a directional radiation pattern.

It should be appreciated that the broadband behavior of preferred embodiments of the present invention is achieved with a non-balance feed configuration. Accordingly, a broadband balun is not required according to embodiments of the present invention, thereby allowing an antenna configuration significantly reduced in size as compared to various prior art configurations, such as the Vivaldi tapered slot antenna.

Embodiments of the present invention include a shorting pin or shorting plate configuration to generate an additional mode. Using such a shorting pin, the lowest resonance frequency of a wideband tapered strip antenna element of the present invention is not limited by the aperture size. Therefore, such embodiments may be utilized to facilitate an antenna configuration further reduced in size. For example, embodiments of the present invention implementing a shorting pin provide a wideband tapered strip antenna element sized approximately $0.14\lambda_0$, where $\lambda_0$ is the wave length of the lower resonance frequency.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawing, in which.

DETAILED DESCRIPTION OF THE INVENTION

Figure 1A:
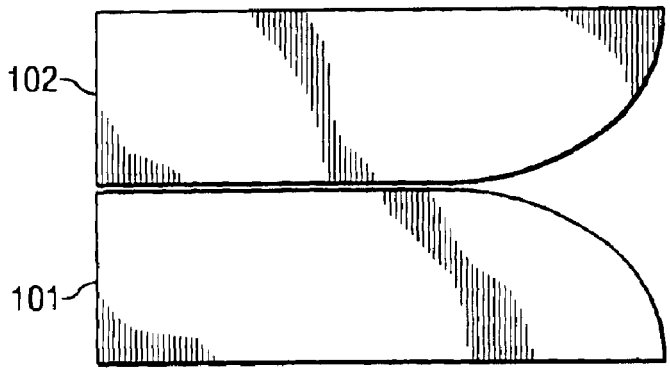
FIG. 1A (PRIOR ART)
FIGS. 1A–1C show prior art Vivaldi antenna configurations.
Figure 1B:
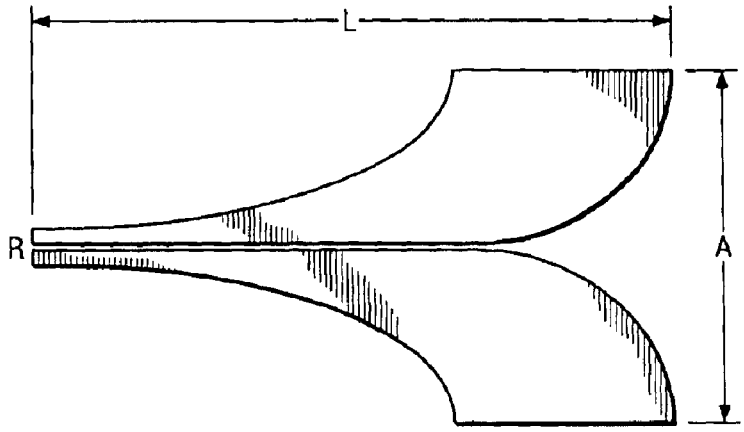
FIG. 1B (PRIOR ART)
Figure 1C:
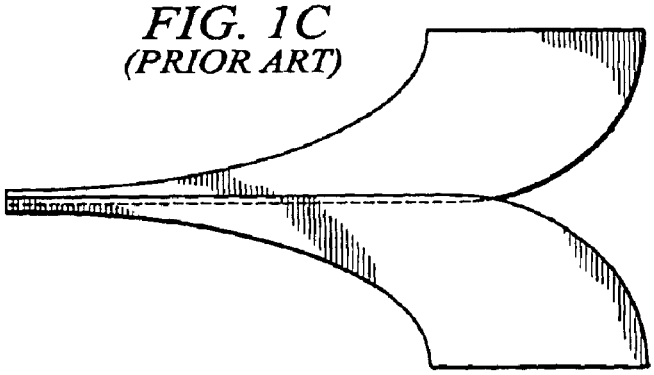
FIG. 1C (PRIOR ART)
Figure 2:
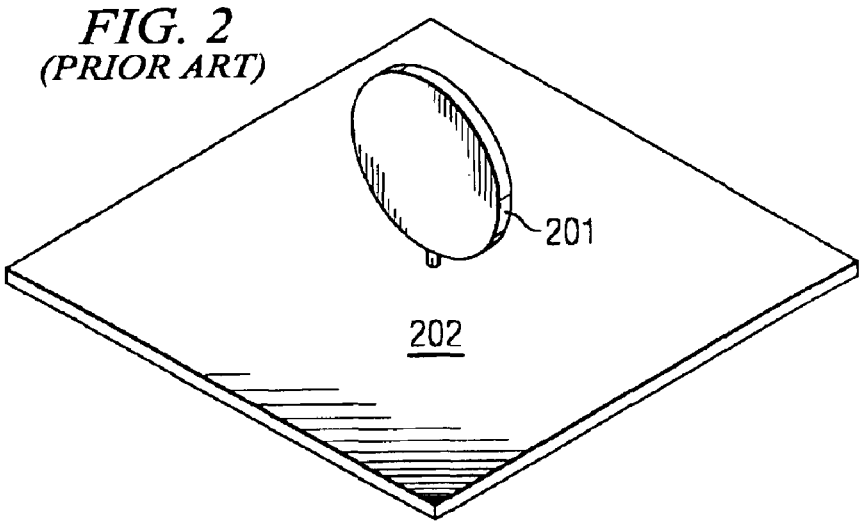
FIG. 2 (PRIOR ART)
FIG. 2 shows a prior art planar circular monopole antenna configuration.
Figure 3:
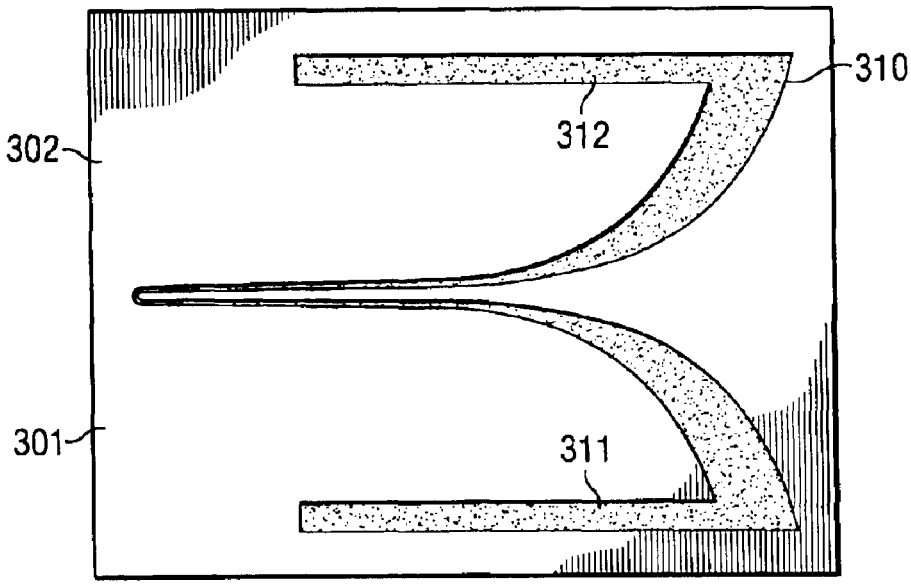
FIG. 3 (PRIOR ART)
FIG. 3 shows a prior art broadband parallel plate antenna configuration.
Figure 4A:
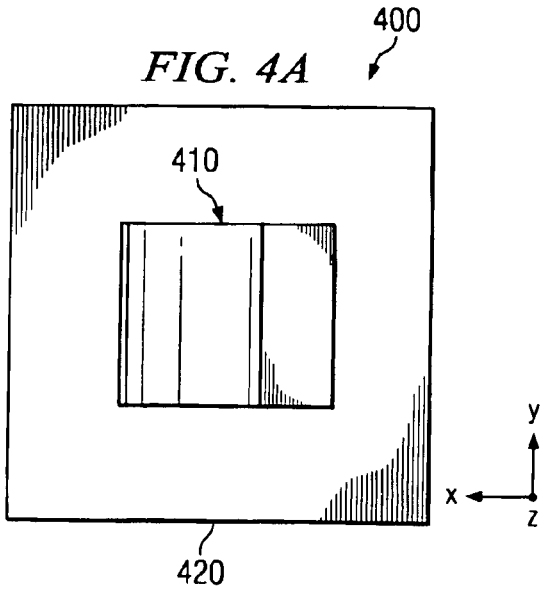
FIGS. 4A–4D show various views of a broadband tapered strip antenna according to an embodiment of the present invention.
Figure 4B:
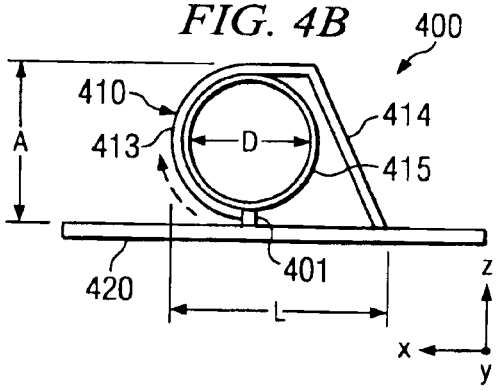
Figure 4D:
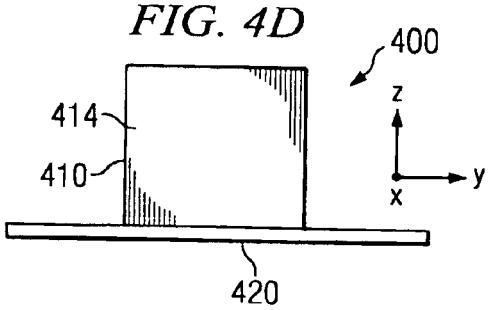
Figure 4C:
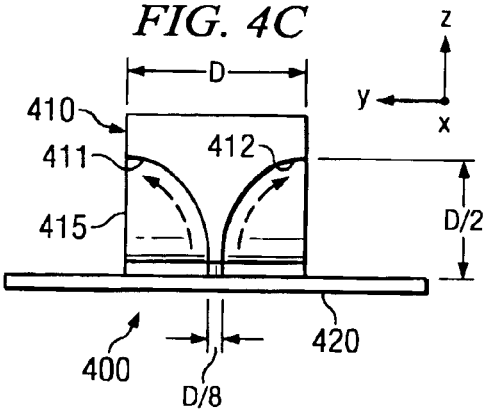
Figure 5A:
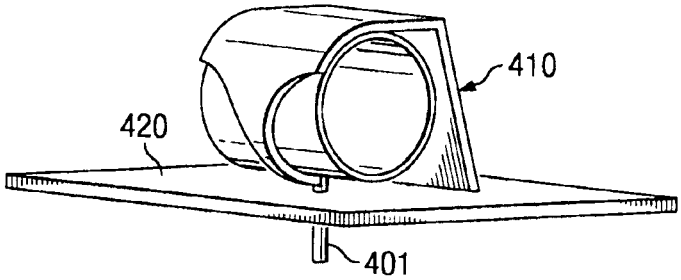
FIGS. 5A and 5B show isometric views of the broadband tapered strip antenna of FIGS. 4A–4D.
Figure 5B:
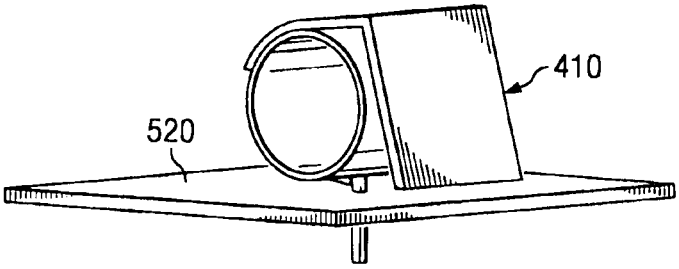

Directing attention to FIGS. 4A–4D, a preferred embodiment of wideband tapered strip antenna 400 is shown in various views. Specifically, FIG. 4A presents a top plan view of wideband tapered strip antenna 400, FIG. 4B presents a side view of wideband tapered strip antenna 400, FIG. 4C presents a front view of wideband tapered strip antenna 400, and FIG. 4D presents a rear view of wideband tapered strip antenna. FIGS. 5A and 5B provide various isometric views of wideband tapered strip antenna 400, to further aid in the understanding of the configuration of the embodiment illustrated in FIGS. 4A–4D.

Wideband tapered strip antenna 400 of the illustrated embodiment comprises conductor strip 410 disposed over ground plane 420 and having signal feed mechanism 401, shown here disposed at a position in the gap between conductor strip 410 and ground plane 420 where the gap is smallest, such that conductor strip 410 acts as an anode and ground plane 420 substitutes as the corresponding cathode. Signal feed mechanism 401 may comprise any number of mechanisms for interfacing signals to/from wideband tapered strip antenna 400. For example, signal feed mechanism 401 may comprise an unterminated end of a transmission line disposed in the gap between conductor strip 401 and ground plane 420 and electrically isolated therefrom. Alternatively, signal feed mechanism 401 may comprise a waveguide, a microstrip line, or other suitable signal transducer.

Also shown in the embodiment of FIGS. 4A–4D is shorting pin or plate 414, coupling an end of conductor strip 410 distal from signal feed mechanism 401 to ground plane 420. Shorting plate 414 of a preferred embodiment is utilized to generate an additional mode, a shorted loop mode, thereby providing a wideband tapered strip antenna element configuration in which the lowest resonance frequency is not limited by the aperture size.

As can be seen in the figures, conductor strip 410 of the illustrated embodiment has a plurality of tapering parameters associated therewith, effectively presenting a self-similar characteristic to signal feed mechanism 401. Specifically, conductor strip 410 includes taper 413, also referred to herein as an aperture taper, providing a curved face thereof. Additionally, conductor strip 410 includes tapers 411 and 412, also referred to herein as an impedance taper, providing curved edges thereof. These tapering parameters affect the overall performance of wideband tapered strip antenna 100 and are, therefore, selected accordingly. Generally speaking, taper 413 (the aperture taper) is optimized for wave launching characteristics ensuring broadband effects. Tapers 411 and 412 (the impedance taper) ensure a constant impedance through the bands.

Other parameters of wideband tapered strip antenna 400 may also be used to affect the overall performance of the antenna. For example, a length parameter of wideband tapered slot antenna 400 (shown as L and FIG. 4B) may be adjusted to affect polarization purity. Additionally or alternatively, a dielectric parameter (not shown) may be adjusted, such as by introducing a dielectric in the current path to slow propagation and, thus, allow a reduction in the effective aperture size (shown as A in FIG. 4B). For example, an overall size of wideband tapered slot antenna 400 is reduced according to one embodiment by placing dielectric material in the gap between conductor strip 410 and ground plane 420 from an area just in front of signal feed mechanism 401 towards the antenna aperture. Beam focusing may also be achieved using such a dielectric.

Taper 413 of the illustrated embodiment is substantially a portion of a circular radius, as defined by form 415. For example, form 415 may comprise a non-conductive, and preferably radio frequency (RF) transparent, cylinder, such as may be comprised of glass, plastic, polymeric resin, or other shapeable material known in the art, around which conductor strip 410 is formed. Accordingly, conductor strip 410 of the illustrated embodiment acquires taper 413 corresponding to a surface portion of form 415. The radius of form 415, and thus the tapering parameter associated with taper 413, is preferably selected to provide an aperture (A as shown in FIG. 4B) of sufficient size to provide a desired lowest resonance frequency while providing an antenna element having an acceptable overall size and/or a length (L as shown in FIG. 4B) of sufficient size to provide desired operating characteristics, such as polarization.

Although the illustrated embodiment is shown having a substantially rounded aperture tapering parameter, it should be appreciated that other configurations of aperture tapers may be utilized according to the present invention. For example, taper 413 may follow the contour of an oval, such as an oval disposed longitudinally parallel to ground plane 420, to provide an increased length parameter, L, such as to increase polarization purity. Moreover, the shape of aperture tapers may be selected according to embodiments of the present invention to govern the directivity of the wideband tapered strip antenna. For example, the circular embodiment of the illustrated embodiment results in a wave front propagating along a vector approximately 45° with respect to the ground plane surface shown in FIG. 4B. Selecting a tapering characteristic resulting in a more oblate profile of conducting strip 410 (e.g., using an oval disposed longitudinally parallel to ground plane 420 in the profile of FIG. 4B) would result in a wave front propagating along a vector less than 45° with respect to the ground plane surface shown in FIG. 4B (a vector more towards the X axis). Alternatively, selecting a tapering characteristic resulting in a more erect profile of conducting strip 410 (e.g., using an oval disposed longitudinally orthogonal to ground plane 420 in the profile of FIG. 4B) would result in a wave front propagating along a vector more than 45° with respect to the ground plane surface shown in FIG. 4B (a vector more towards the Z axis).

Although the aperture size of wideband tapered strip antenna 400 is proportional to a lower resonate frequency of an operating band according to embodiments of the present invention, it should be appreciated that selection of particular parameters of wideband tapered strip antenna 400, such as the aforementioned dielectric parameter, or the use of a shorting pin may facilitate an aperture appreciably smaller than a quarter wavelength (i.e., $A<\lambda_0/4$, where $\lambda_0$ is free space wavelength of the lowest resonance frequency). For example, a prototype wideband tapered strip antenna, sized in the dimension (D) proportions as show in FIGS. 4A–4D to have an aperture (A of FIG. 4B) of approximately $0.14\lambda_0$ and a length (L of FIG. 4B) of approximately $0.19\lambda_0$, has been tested to provide satisfactory operation at a lowest resonance frequency $\lambda_0$.

Tapers 411 and 412 of the illustrated embodiment are substantially a portion of a circular radius cut out along edges of the face of conductor strip 410 curved by taper 413. The curvature of tapers 411 and 412 is preferably selected so as to present a desired impedance at feed mechanism 401, such as 50Ω to match a typical transmission line impedance, and to provide a relatively good impedance match throughout a band of operation. Specifically, tapers 411 and 412 are preferably selected to produce a relatively frequency independent impedance. Accordingly, tapers 411 and 412 preferably result in the relatively thin width of conductor strip 410 reaching a desired full width at or before taper 413 completes the aperture curve.

Figure 6:
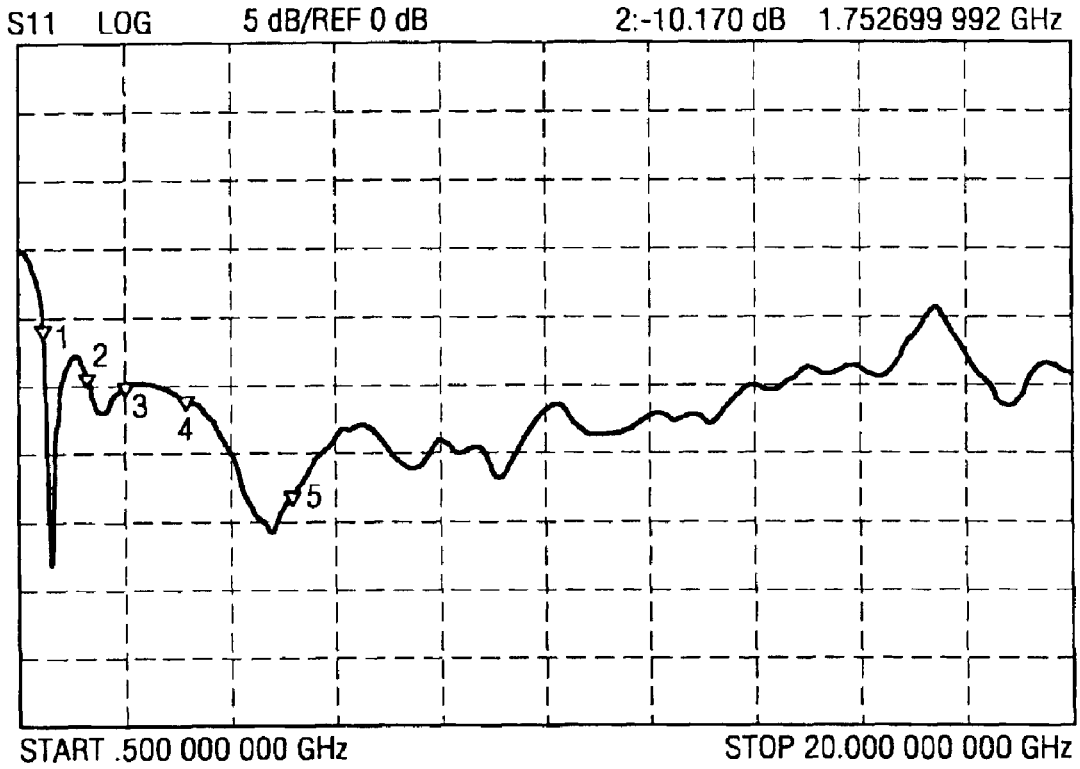
FIG. 6 shows a graph of the measured input return loss of an embodiment of a wideband tapered strip antenna of the present invention.

Directing attention to FIG. 6, a graph of the measured input return loss of the above described prototype wideband tapered strip antenna configuration is shown. As can readily be appreciated from the graph, the prototype antenna provides ultra-broadband operation, having an operating band from approximately 1.7 GHz to approximately 14 GHz. Moreover, an additional resonance is generated at approximately 1 GHz. Accordingly, the prototype wideband tapered strip antenna is suitable for use with cellular services operating at 900 MHz, such as GSM systems, as well as wireless systems operable above 1.7 GHz. Stated another way, wideband tapered strip antenna configurations of embodiments of the present invention provide overall bandwidth of approximately 14:1, at a size approximately half that of a standard monopole operable at the same lowest operating band.

Due to the ultra wideband operation provided by embodiments of the present invention, wideband tapered strip antennas as described herein may be utilized with respect to substantially any or all modern wireless communication systems, such as those operable at 900 MHz, 1.8 GHz, 1.9 GHz, 2.4 GHz, and 5 GHz. Similarly, wideband tapered strip antennas of the present invention may be utilized with respect to UWB digital pulse wireless communications.

Figure 7A:
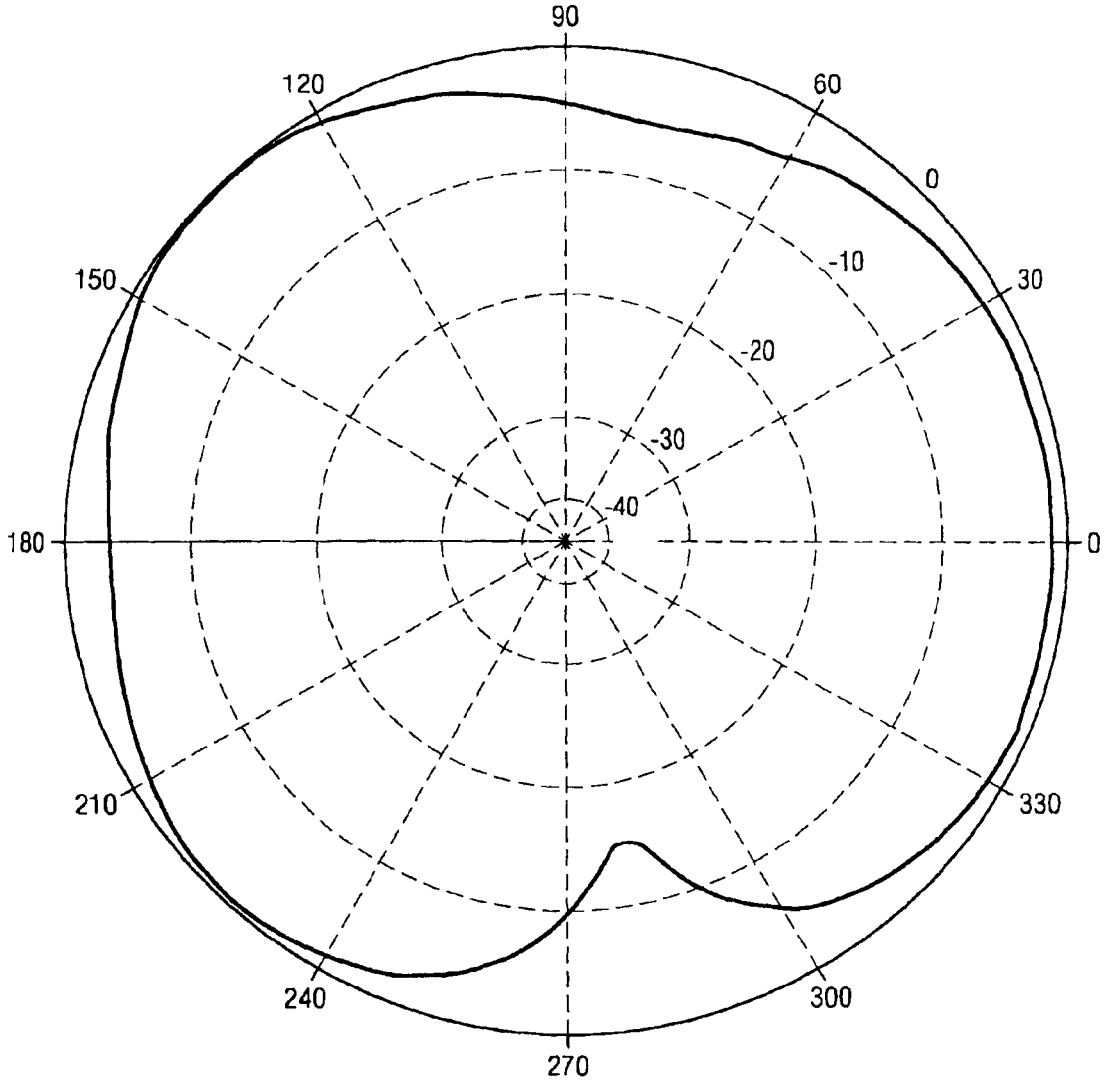
FIGS. 7A, 7B, and 7C show radiation patterns of various frequencies of an embodiment of a wideband tapered strip antenna of the present invention.
Figure 7B:
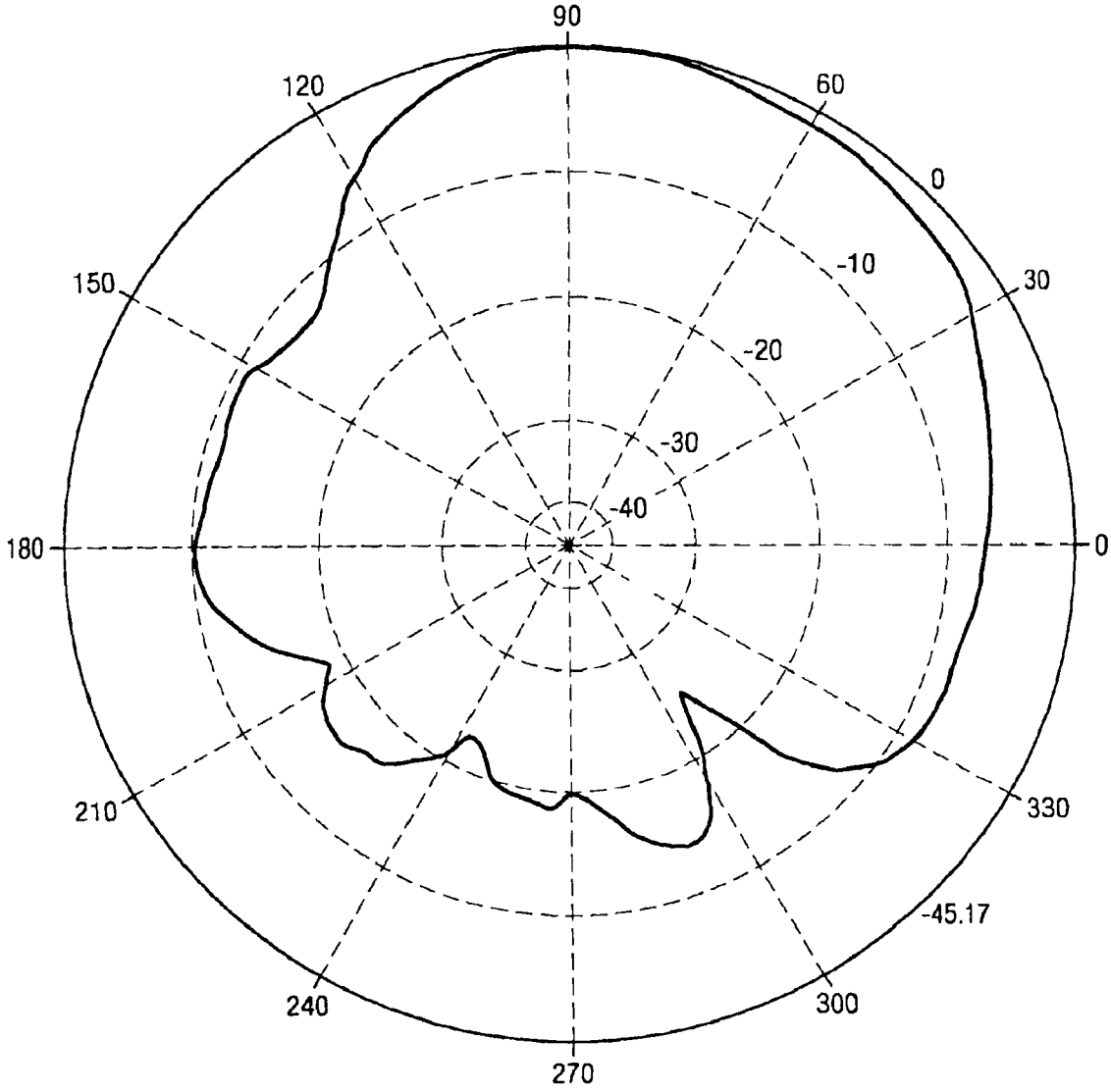
Figure 7C:
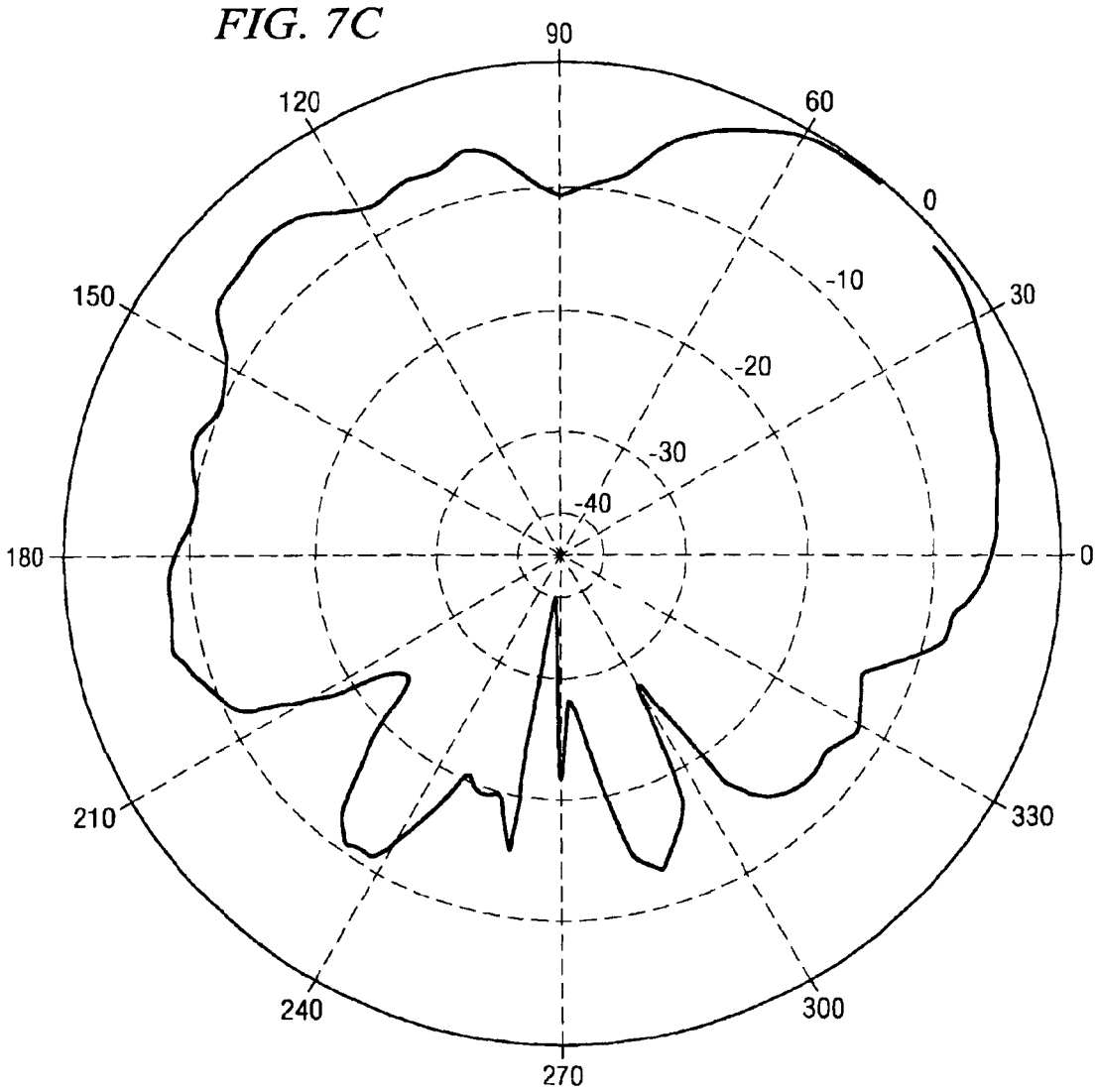

FIGS. 7A–7C show the measured radiation patterns at particular frequencies within the operating band of the prototype antenna. Specifically, FIG. 7A shows the far field radiation pattern of the prototype wideband tapered strip antenna at 900 MHz, FIG. 7B shows the far field radiation pattern of the prototype wideband tapered strip antenna at 2.45 GHz, and FIG. 7C shows the far field radiation pattern of the prototype wideband tapered strip antenna at 5.2 GHz. The radiation pattern of FIG. 7A shows a substantially omni directional radiation pattern associated with the shorted loop mode at 900 MHz. The radiation patterns of FIGS. 7B and 7C, for 2.45 GHz and 5.2 GHz respectively, show radiation patterns towards the X Z plane at about 45 to 50 degrees.

As discussed above, the wideband tapered strip antenna configuration of the embodiment illustrated in FIGS. 4A–4D includes two different modes of radiation; one being continuous wave radiation, and the other being shorted loop mode radiation. Also as discussed above, the shorted loop mode is advantageous in providing a wideband tapered strip antenna to resonate at lower frequencies than are otherwise practical. Thus, shorting plate 414 is included in the illustrated embodiment. However, it should be appreciated that shorting pins utilized according to the present invention may comprise configurations different than that shown in the embodiment of FIGS. 4A–4D. For example, shorting pins of the present invention may be adapted to optimize the additional resonance generated.

Figure 8A:
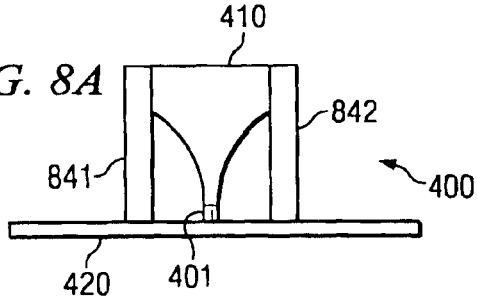
FIGS. 8A and 8B show alternative embodiments of shorting pins useful in embodiments of wideband tapered strip antennas of the present invention.
Figure 8B:
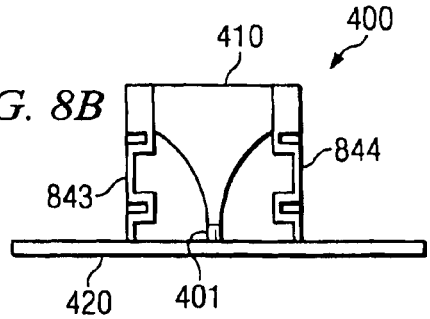

Various configurations of shorting pin configurations are shown in FIGS. 8A and 8B, providing rear views of wideband tapered strip antenna 400 corresponding to the rear view of FIG. 4D. In the embodiment of FIG. 8A, shorting plate 414 has been replaced by shorting strips 841 and 842. It should be appreciated that shorting strips 841 and 842 provide substantially the same operation as shorting plate 414, except perhaps inducing inductive characteristics and lowering the resonance frequency somewhat. However, the wideband tapered strip antenna configuration of FIG. 8A provides an embodiment utilizing less material than that of FIGS. 4A–4D, thereby providing a lighter and perhaps less expensive configuration. In the embodiment of FIG. 8B, shorting plate 414 has been replaced by shorting strips 843 and 844. It should be appreciated that shorting strips 843 and 844 include "meanders" therein, thereby increasing the current path length in the shorted loop mode and reducing the resonance frequency of the lower band.

Embodiments of the present invention may omit shorting pins or plates, such as where lower frequency band operation is not desired. Additionally or alternatively, embodiments of the present invention may provide one or more selectable shorting pins, such as by inserting PIN diodes therein for selecting a shorting pin by providing a controlling bias to appropriate ones of the PIN diodes.

Figure 9:
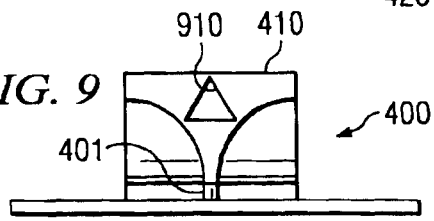
FIG. 9 shows an alternative embodiment of a conducting strip useful in embodiments of wideband tapered strip antennas of the present invention.

Embodiments of wideband tapered strip antennas of the present invention may included additional or alternative modifications to those discussed above with respect to the shorted loop mode. For example, the face of conductor strip 410 may be modified to create a multiple band antenna instead of ultra broadband performance. Directing attention to FIG. 9, providing a front view of wideband tapered strip antenna 400 corresponding to the front view of FIG. 4C, an embodiment including slot 910 in the face of conductor strip 410 to provide multi-band operation is shown. Slot 910 is preferably sized and shaped to result in blocking a portion of the frequency band wideband tapered slot antenna 400 would otherwise respond to, thereby providing an upper and lower band of operation. Specifically, the higher frequency resonance will be determined by the position of slot 910 relative to signal feed mechanism 401 and the lower frequency resonance will be determined by the band blocked by slot 910 (proportional to the size of slot 910) and the lowest resonate frequency of the antenna.

Although preferred embodiments have been described herein with reference to radiation of signals, it should be appreciated that the wideband tapered strip antennas of the present invention are useful with respect to transmitters, receivers, and/or transceivers. Accordingly, references to transmission or radiation of signals herein are intended to cover the reverse as well.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An antenna element comprising:

a conductor strip having a face thereof tapered to thereby define an aperture taper; and a ground plane disposed parallel to at least a portion of said face, wherein a signal feed gap remains between said conductor strip and said ground plane at said at least a portion of said face.

2. The antenna element of claim 1, wherein said aperture taper is sized and shaped to provide a desired operating frequency band.

3. The antenna element of claim 2, wherein said desired operating frequency band is a broadband frequency band.

4. The antenna element of claim 2, wherein said desired operating band comprises the range of frequencies from approximately 1.7 GHz to approximately 14 GHz.

5. The antenna element of claim 1, wherein said aperture taper of said conductor strip comprises a portion of a circular curve.

6. The antenna element of claim 1, wherein a wave front propagation vector angle associated with signals radiated by said antenna element is approximately 45° from a surface of said ground plane.

7. The antenna element of claim 1, wherein said aperture taper of said conductor strip comprises a portion of an ovular curve.

8. The antenna element of claim 7, wherein an oval of said ovular curve is disposed parallel to a surface of said ground plane.

9. The antenna element of claim 8, wherein a wave front propagation vector angle associated with signals radiated by said antenna element is less than 45° from a surface of said ground plane.

10. The antenna element of claim 7, wherein an oval of said ovular curve is disposed orthogonal to a surface of said ground plane.

11. The antenna element of claim 10, wherein a wave front propagation vector angle associated with signals radiated by said antenna element is greater than 45° from a surface of said ground plane.

12. The antenna element of claim 1, wherein said conductor strip further has at least one edge of said face tapered to thereby define an impedance taper.

13. The antenna element of claim 12, wherein said impedance taper is sized and shaped to provide an approximately constant impedance throughout a desired operating frequency band.

14. The antenna element of claim 12, wherein said impedance taper reduces a width of said conductor strip to a minimum magnitude at said at least a portion of said face.

15. The antenna element of claim 12, wherein said impedance taper provides impedance of approximately 50 ohms with respect to a signal feed mechanism interfaced therewith.

16. The antenna element of claim 1, further comprising:

a shorting pin electrically coupling said ground plane to an end of said conductor strip distal to said at least a portion of said face.

17. The antenna element of claim 16, wherein said shorting pin provides frequency termination with respect to lower frequencies of a desired operating band.

18. The antenna element of claim 16, wherein said shorting pin provides a shorted loop mode of operation with respect to said antenna element.

19. The antenna element of claim 18, wherein said shorted loop mode of operation provides a resonance frequency below a lowest resonance frequency of a desired operating band of said antenna element.

20. The antenna element of claim 19, wherein said desired operating band comprises a bandwidth wherein an upper frequency of said bandwidth is at least 8 times a lower frequency of said bandwidth.

21. The antenna element of claim 16, wherein said shorting pin comprises a shorting plate having a width corresponding to a width of said conductor strip.

22. The antenna element of claim 16, wherein said shorting pin comprises a shorting strip having a width smaller than a width of said conductor strip.

23. The antenna element of claim 16, wherein said shorting pin comprises a signal delay mechanism.

24. The antenna element of claim 23, wherein said signal delay mechanism comprises a meander.

25. The antenna element of claim 16, further comprising:

a shorting pin selection circuit operable to selectively implement said shorting pin.

26. The antenna element of claim 25, wherein said signal pin selection circuit comprises:

at least one PIN diode disposed in a signal path of said shorting pin.

27. The antenna element of claim 1, further comprising:

a dielectric material disposed in said signal feed gap.

28. The antenna element of claim 1, wherein an aperture, A, associated with said aperture taper is less than one quarter wavelength of a lowest frequency of a desired band of operation, such that $A<\lambda_0/4$, where $\lambda_0$ is free space wavelength of the lowest resonance frequency of the desired band of operation.

29. The antenna element of claim 28, wherein said aperture, A, is approximately $0.14\lambda_0$.

30. The antenna element of claim 1, wherein an overall length, L, of said antenna element, measured in a direction parallel to said signal feed gap, is less than one quarter wavelength of a lowest frequency of a desired band of operation, such that $L<\lambda_0/4$, where $\lambda_0$ is free space wavelength of the lowest resonance frequency of the desired band of operation.

31. The antenna element of claim 30, wherein said length, L, is approximately $0.19\ \lambda_0$.

32. An antenna element comprising:

a conductor strip having a face thereof tapered to thereby define an aperture taper, wherein said aperture taper is sized and shaped to provide a desired operating frequency band, said conductor strip further having at least one edge of said face tapered to thereby define an impedance taper, wherein said impedance taper is sized and shaped to provide an approximately constant impedance throughout said desired operating frequency band.

33. The antenna element of claim 32, wherein said desired operating frequency band is a broadband frequency band.

34. The antenna element of claim 32, wherein said desired operating band comprises a bandwidth wherein an upper frequency of said bandwidth is at least 8 times a lower frequency of said bandwidth.

35. The antenna element of claim 32, wherein an aperture, A, associated with said aperture taper is less than one quarter wavelength of a lowest frequency of said desired band of operation, such that $A<\lambda_0/4$, where $\lambda_0$ is free space wavelength of the lowest resonance frequency of the desired band of operation.

36. The antenna element of claim 35, wherein said aperture, A, is approximately $0.14\lambda_0$.

37. The antenna element of claim 32, wherein said aperture taper of said conductor strip comprises a portion of a circular curve.

38. The antenna element of claim 32, wherein said aperture taper of said conductor strip comprises a portion of an ovular curve.

39. The antenna element o claim 32, wherein said impedance taper reduces a width of said conductor strip to a minimum magnitude at a portion of said conductor strip interfaced with a signal feed mechanism.

40. The antenna element of claim 32, wherein said impedance taper provides impedance of approximately 50 ohms with respect to a signal feed mechanism interfaced therewith.

41. The antenna element of claim 32, further comprising:

a ground plane disposed parallel to at least a portion of said face of said conductor strip, wherein a signal feed gap remains between said conductor strip and said ground plane at said at least a portion of said face.

42. The antenna element of claim 41 wherein an overall length, L, of said antenna element, measured in a direction parallel to said signal feed gap, is less than one quarter wavelength of a lowest frequency of said desired band of operation, such that $L<\lambda_0/4$, where $\lambda_0$ is free space wavelength of the lowest resonance frequency of the desired band of operation.

43. The antenna element of claim 42, wherein said length, L, is approximately $0.19\ \lambda_0$.

44. The antenna element of claim 41, further comprising:

a shorting pin electrically coupling said ground plane to an end of said conductor strip distal to said at least a portion of said face.

45. The antenna element of claim 44, wherein said shorting pin provides frequency termination with respect to lower frequencies of a desired operating band.

46. The antenna element of claim 44, wherein said shorting pin provides a shorted loop mode of operation with respect to said antenna element.

47. The antenna element of claim 46, wherein said shorted loop mode of operation provides a resonance frequency below a lowest resonance frequency of said desired operating band of said antenna element.

48. The antenna element of claim 44, wherein said shorting pin comprises a shorting plate having a width corresponding to a width of said conductor strip.

49. The antenna element of claim 44, wherein said shorting pin comprises a shorting strip having a width smaller than a width of said conductor strip.

50. The antenna element of claim 44, wherein said shorting pin comprises a signal delay mechanism.

51. The antenna element of claim 44, further comprising:

a shorting pin selection circuit operable to selectively implement said shorting pin.

52. The antenna element of claim 41, further comprising:

a dielectric material disposed in said signal feed gap.

53. A method for providing a broadband antenna, said method comprising:

tapering a face of a conductor strip to define an aperture taper;

disposing said conductor strip in juxtaposition with a ground plane, wherein at least a portion of said tapered face of said conductor strip is parallel to said ground plane and a signal feed gap remains between said at least a portion of said tapered face and said ground plane.

54. The method of claim 53, further comprising:

sizing said aperture taper to provide a desired operating frequency band.

55. The method of claim 54, wherein said desired operating frequency band is a broadband frequency band.

56. The method of claim 54, wherein said desired operating band comprises a bandwidth wherein an upper frequency of said bandwidth is at least 8 times a lower frequency of said bandwidth.

57. The method of claim 53, wherein said tapering said face of said conductor strip comprises:

providing a circular curve to said face of said conductor strip.

58. The method of claim 53, wherein said tapering said face of said conductor strip comprises:

providing an ovular curve to said face of said conductor strip.

59. The method of claim 53, further comprising:

tapering at least one edge of said tapered face of said conductor strip to define an impedance taper.

60. The method of claim 59, further comprising:

sizing said impedance taper to provide an approximately constant impedance throughout a desired operating frequency band.

61. The method of claim 59, wherein tapering said at least one edge of said tapered face comprises:

tapering at least two opposing edges of said tapered face of said conductor strip.

62. The method of claim 59, wherein said impedance taper provides impedance of approximately 50 ohms with respect to a signal feed mechanism interfaced therewith.

63. The method of claim 53, further comprising:

electrically coupling said ground plane to an end of said conductor strip distal to said at least a portion of said face using a shorting pin.

64. The method of claim 63, wherein said shorting pin provides frequency termination with respect to lower frequencies of a desired operating band.

65. The method of claim 63, wherein said shorting pin provides a shorted loop mode of operation with respect to said method.

66. The method of claim 65, wherein said shorted loop mode of operation provides a resonance frequency below a lowest resonance frequency of a broadband operating band of said broadband antenna.

67. The method of claim 66, wherein said broadband operating band comprises a bandwidth wherein an upper frequency of said bandwidth is at least 8 times a lower frequency of said bandwidth.

68. The method of claim 63, further comprising:

delaying signal propagation between said ground plane to an end of said conductor strip distal to said at least a portion of said face using a signal delay mechanism.

69. The method of claim 68, wherein said signal delay mechanism comprises a meander.

70. The method of claim 63, further comprising:

dynamically implementing said shorting pin using a shorting pin selection circuit.

71. The method of claim 53, further comprising:

placing a dielectric material in said signal feed gap.

* * * * *